US007082974B1

(12) United States Patent
Vice

(10) Patent No.: US 7,082,974 B1
(45) Date of Patent: Aug. 1, 2006

(54) BOX JOINT FIXTURE AND METHOD

(76) Inventor: James Perry Vice, 288 Boeing Ct., Livermore, CA (US) 94551

( * ) Notice: Subject to any disclaimer, the term of this patent is extended or adjusted under 35 U.S.C. 154(b) by 345 days.

(21) Appl. No.: 10/799,014

(22) Filed: Mar. 11, 2004

(51) Int. Cl.
*B27C 9/00* (2006.01)
*B27M 1/00* (2006.01)
*B27M 1/08* (2006.01)

(52) U.S. Cl. ..... 144/371; 144/204.2; 144/253.1; 144/253.5; 269/297; 269/304

(58) Field of Classification Search ..... 144/253.1, 144/371, 253.5, 204.2; 83/440, 44.1, 442, 83/857; 33/638, 628, 562; 269/315, 304, 269/308, 297, 298, 300
See application file for complete search history.

(56) References Cited

U.S. PATENT DOCUMENTS 1,713,329 A * 5/1929 Clayton ..... 144/204.2
5,018,562 A * 5/1991 Adams ..... 144/253.1
6,041,837 A * 3/2000 Hanson ..... 144/371
6,520,225 B1 * 2/2003 Dembicks ..... 144/253.5
6,588,468 B1 * 7/2003 Tucker et al. ..... 144/372

* cited by examiner

*Primary Examiner*—Bena Miller
(74) *Attorney, Agent, or Firm*—Risto A. Rinne, Jr.

(57) ABSTRACT

An apparatus for cutting dados in two boards used to form a box joint includes a support member and a rear member adapted for securing the apparatus to a miter of a table saw or to another type of a woodworking power tool. An insert assembly in the support member includes an adjustable elliptical pin having an oval shaped cross-section. The elliptical pin is adapted for rotational placement into a dado cut and, subsequent to its rotation sufficient to remove all slack intermediate the pin and the boards followed by a tightening thereof, for securing the boards in place for subsequent dado cuts. An insert is placed in the insert assembly and is used to establish the proper offset from the elliptical pin to a dado blade or other type of a cutting instrument. Different sized elliptical pins and inserts are used with different sized dado blades or cutting instruments. The step sequence necessary to make all of the dado cuts in both boards is described.

15 Claims, 3 Drawing Sheets

BOX JOINT FIXTURE AND METHOD

BACKGROUND OF THE INVENTION

1. Field of the Invention

The present invention, in general relates to woodworking and, more particularly, to devices used to form a box joint or a corner joint.

In woodworking, it is often necessary to securely join two pieces of wood together at a right angle. This occurs at corners when two pieces of wood merge together. A common example is when constructing boxes. A corner connection of two pieces of wood is sometimes also referred to as a "joint" or as a "corner joint".

It is well known in woodworking, that the strongest right angle joint (i.e., corner joint) possible is called a box joint. A box joint consists of a plurality of cut out segments, each called a dado, formed in each piece at each end. They must be cut so that the two pieces of wood match perfectly at the corner, with even tops and bottoms. Each of the cuts must be the same size as the fingers in the opposite piece. Furthermore, the spacing between each is critical. Once formed, the corners are fitted and glued together, each finger being inserted and glued into each corresponding dado cut.

Ideally, a small excess amount of material is provided for sanding. Accordingly, the dado cuts extend into the wood an amount that slightly exceeds the thickness of the wood, which results in a slight protrusion of each set of fingers extending out in each direction at the corner.

A corner joint that includes such a plurality of fingers and dado cuts that cooperate with each other is called a "box joint". It is also sometimes referred to as a "finger joint". Although box joints are the strongest corner joint possible and are attractive (i.e., a box joint's very appearance exudes quality of construction), they are seldom used, except in the most expensive pieces of furniture.

The reason for this lack of use is because they are especially difficult to make. They take a lot of time and labor, for example, there is much careful measurement required to ensure accuracy and to avoid error. An error in just one of many cuts will ruin the piece of wood, which may have already had a lot of work expended in its preparation.

Not only does each piece of wood that is to be joined require careful measurement as to where the dado cuts will be made, they must match perfectly with the fingers of the corresponding piece of wood. In other words the fingers of a first piece of wood must correspond with the dado cuts of the second piece of wood that is used to form the corner joint.

Prior art devices generally produce unsatisfactory results. They provide a reference that applies an expansive force at the bottom of the fingers, which tends to separate the fingers and introduce error. There is little or no indication of where to make each successive cut in the first piece of wood and there is no indication for making the cuts in the next piece of wood that will correspond perfectly with the cuts that have been made in the current (first) piece. For the homeowner or small scale woodworker, making box joints presents a formidable challenge.

For the woodworking novice, just learning these techniques, the challenge is substantial. Many people abandon their desire to progress in the woodworking arts because of an inability that they experience in making a successful box joint.

Accordingly, there exists today a need for a box joint fixture and method for cutting box joints to form a corner joint.

Clearly, such an apparatus would be a useful and desirable device and such a method would be similarly well received.

2. Description of Prior Art

Box joint fixtures are, in general, known. For example, the following patents describe a type of this device:

U.S. Pat. No. 6,041,837 to Hansen, Mar. 28, 2000.

While the structural arrangements of the above described device, at first appearance, may have certain similarities with the present invention, it differs in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a box joint fixture that is easy to use.

It is also an important object of the invention to provide a box joint fixture that securely holds a piece of wood in the proper position to make a next cut.

Another object of the invention is to provide a box joint fixture that is adapted to make a variety of different sized box joint cuts.

Still another object of the invention is to provide a box joint fixture that provides a positive reference to set up the position of the fixture to make the next successive cut.

Still yet another object of the invention is to provide a box joint fixture that provides a reference suitable to make cuts in both pieces that are used to form a box joint corner.

Yet another important object of the invention is to provide a box joint fixture that can cut two pieces of wood simultaneously.

Still yet another important object of the invention is to provide a box joint fixture that uses a cam to secure the wood to be cut in position.

Still one other important object of the invention is to provide a box joint fixture that attaches to a miter of a table saw.

Still one additional important object of the invention is to provide a box joint fixture that includes a sacrificial backing board that supports the board being cut and helps prevent chipping of the board being cut.

Still yet one additional important object of the invention is to provide a box joint fixture that includes a cam lock which compensates for variations in the kerfs (i.e., the width of cut) from one dado blade to another.

Still one remaining additional object of the invention is to provide a box joint fixture that attaches to a miter of a router table.

Briefly, a box joint fixture that is constructed in accordance with the principles of the present invention has a support member that is adapted for receiving a first and second board used to form a finger joint therein. An insert assembly is placed in the support member (or could be formed as an integral part thereof) that includes an opening for allowing a dado blade to pass through a bottom of the support member. The opening extends through the support member. A slot is provided through the insert assembly and support member for receiving a dowel (i.e., an elliptical pin) that includes a substantially oval shaped cross-section. A knurled nut on the opposite side of the support member is used to secure the dowel in a desired vertical position. The dowel is adapted to be rotated within a dado cut until a longer portion of the dowel contacts both sides of the dado cut. The dowel is then tightened. The dowel now compensates for the width of cut (i.e., the kerf) of the dado blade and retains the board in position, without slack. Different diameter dowels are used for different width dado blades. The insert assembly includes a pair of vertical slots that extend from each end of the assembly and which are adapted for receiving a precision offset insert. The insert is then used to adjust position of the support member from side to side relative to the dado blade sufficient to make the next dado cut at the proper offset. Once adjusted, all remaining cuts will include the proper offset and, accordingly, the support member need not be further adjusted for a given box joint. A rear member is attached to a miter (if a table saw or router table is used) and is loosened to allow side to side sliding of the support member relative to the miter (i.e., perpendicular with plane of the dado blade). The support member is urged away from the dado blade sufficient to allow a closest edge of the dado blade to just touch the side of the offset insert. The rear member is then tightened and the insert is removed from the assembly. The proper offset from the dowel to the dado blade is thereby set for all remaining cuts. A zero clearance backer board in then preferably placed in the pair of vertical slots prior to making any additional cuts in either board. The backer board provides a solid support for the rear of the boards that are to be cut and thereby helps prevent the boards from chipping when additional dado cuts are made. The backer board also receives one dado cut through it. The backer board is discarded after all dado cuts have been made to form the necessary box joints. According to a described sequence, the two boards are placed in specific order on the dowel and are cut a plurality of times sufficient to fully create an exacting box or "finger" joint.

DETAILED DESCRIPTION OF THE INVENTION

Figure 1:
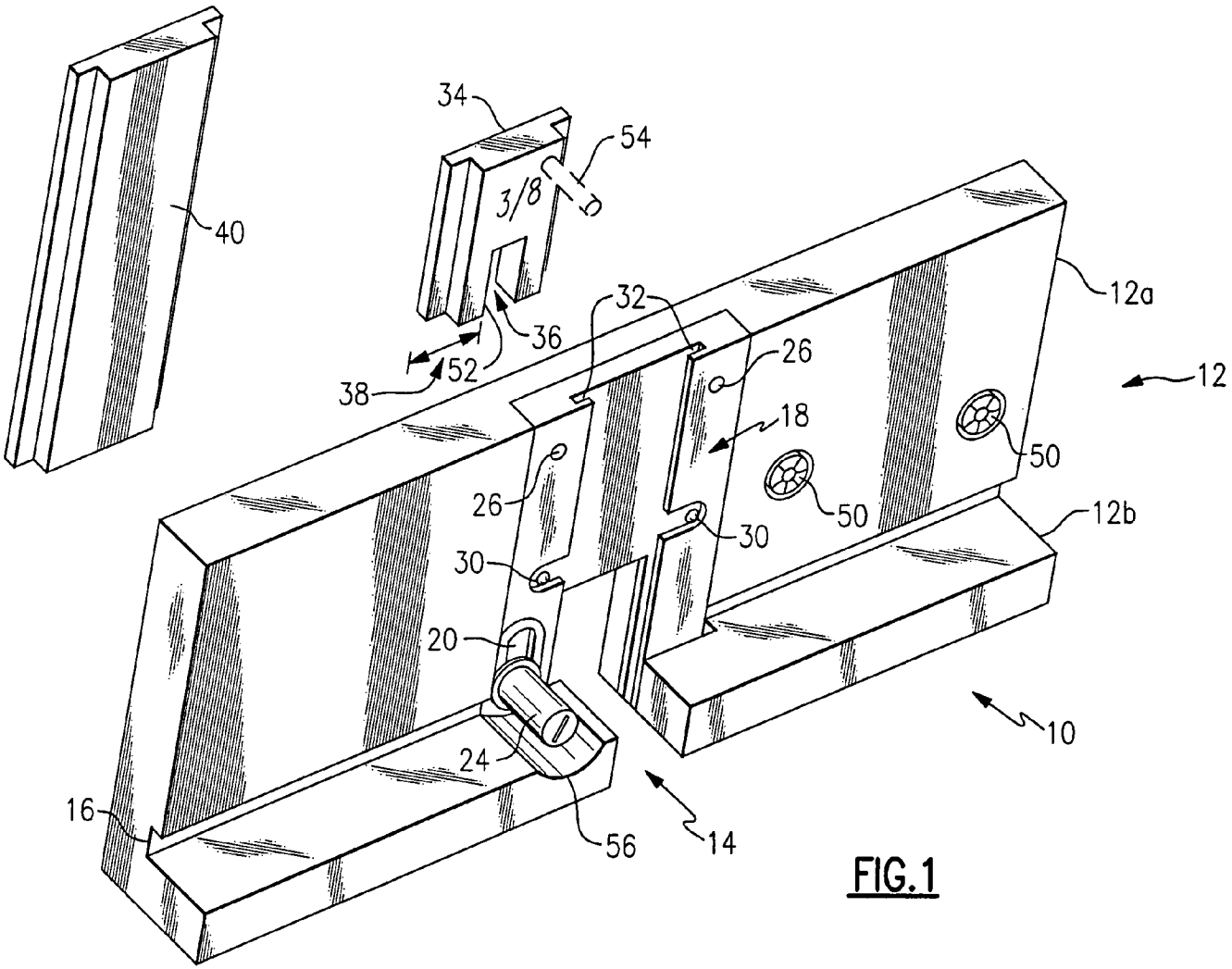
FIG. 1 is a view in perspective of the front of a box joint fixture.

Referring to FIG. 1 is shown, a box joint fixture, identified in general by the reference numeral 10.

A main support member 12 includes an upright planar member 12*a* and an attached smaller horizontal planar member 12*b*.

An opening 14 is provided through the bottom of the support member 12. In use, as is described in greater detail hereinafter, the box joint fixture 10 is attached to a miter (not shown) of a table saw, router table, or other similar type of saw that is capable of receiving a dado blade (not shown).

A dado blade is intended to cut a rectangular cut having a predetermined width. Common widths include ¼, ⅜, and ½ of an inch.

Other widths are, of course, possible. However, a problem with dado blades is that there is tolerance both in the blade and an additional tolerance arising from tolerances inherent in the machine (i.e., the saw) being used. For example, a ⅜ of an inch dado blade may produce a cut in a board that is either more or less than ⅜ of an inch in actual width (i.e., the "kerf" may vary). The good news is that each cut will typically be of the same width, whatever it happens to be.

Nevertheless, one cannot assume that a ⅜ dado cut is actually that width and expect to make an accurate finger joint. Therefore, it is important for the box joint fixture 10 to compensate for variances in the actual widths of cut produced by a given dado blade.

Figure 3:
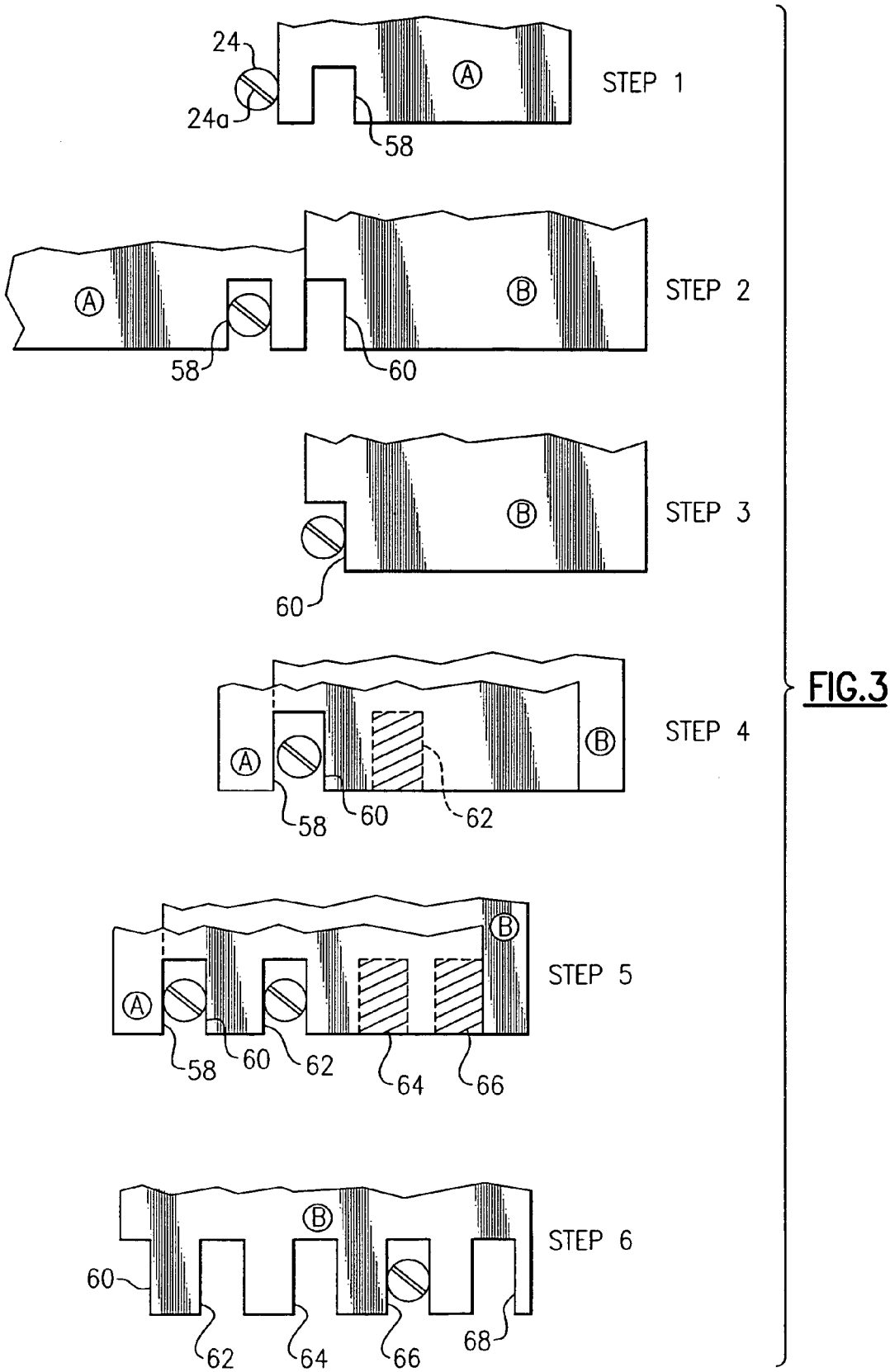
FIG. 3 is a sequence of six partial front elevational views showing the steps necessary on both a first and a second piece of wood using the fixture of FIG. 1 to form the dado cuts necessary to provide a finger joint.

The miter is used to push the box joint fixture 10 over the dado blade, which passes through the opening 14, and cuts a first board, identified in FIG. 3 by the letter "A" and a second board, identified by the letter "B", both of which are used to form the box corner (i.e., the box joint).

A small sawdust recess 16 is provided to allow displacement of any sawdust that might otherwise tend to accumulate at the bottom right-angle intersection of the upright planar member 12*a* and the horizontal planar member 12*b*.

During use, the boards A, B are placed adjacent to a surface of the upright planar member 12*a* with a bottom of the boards A, B that is to be cut by the dado blade on the plane of the horizontal planar member 12*b*. An accumulation of sawdust could prevent the boards A, B from attaining the proper position prior to cutting.

An insert assembly, identified in general by the reference numeral 18, is inserted in a cutout provided in the support member 12. The insert assembly 18 is flush with the surface of the vertical upright planar member 12*a* and it extends fully from the top of the upright planar member to the bottom of the horizontal planar member 12*b*.

The insert assembly 18 includes an opening on the bottom that corresponds and aligns with the opening 14.

Figure 2:
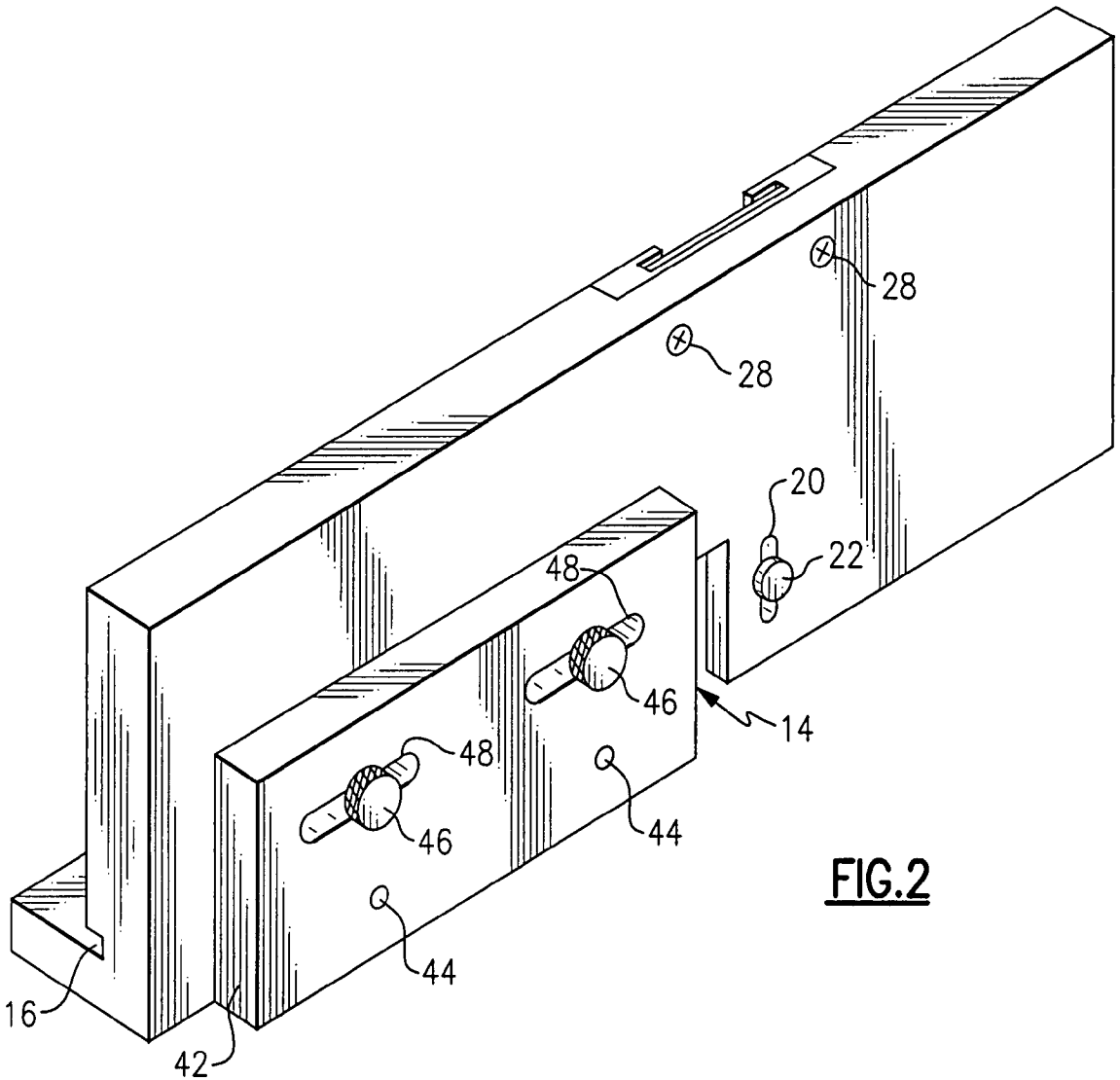
FIG. 2 is a view in perspective of the rear of the box joint fixture of FIG. 1.

A vertical slot 20 is provided through the insert assembly 18 and the support member 12 that is adjacent thereto. A knurled nut 22 (FIG. 2) is used to secure an elliptical pin (the elliptical pin is referred to herein as an oval-shaped dowel 24) where desired (up or down) along the longitudinal length of the vertical slot 20. The dowel 24 does not move side to side in the vertical slot 20.

The dowel 24 (i.e., elliptical pin) is matched with the intended width of the dado blade. If the dado blade is intended to produce a ⅜ of an inch wide dado cut, then a ⅜ of an inch dowel 24 is used. The dowel 24 is machined so that the narrow side of the oval is less than ⅜ of an inch and so the wide portion of the oval is greater than ⅜ of an inch in length. The dowel 24 is formed of any desired material, although a metal or other hard material is generally preferred.

Accordingly, by rotating the dowel 24 about its center longitudinal axis, which the threaded knurled nut 22 provides, the dowel 24 can be adjusted, as is described in greater detail hereinafter, to compensate for variations in the width of cut (kerf) of the dado blade. This is very important.

If a different size of dado blade is used (for example, a ¼ or ½ inch width dado), then a different size of dowel 24 is used. The dowel 24 extends out from the surface of the insert assembly 18 about an inch. This dimension allows for placing up to two ½ inch or ¾ thick boards A, B over the dowel 24 at the same time, as is described in greater detail hereinafter. Of course, a longer or shorter dowel 24 can be used, as desired.

The insert assembly 18 is preferably formed of metal for durability. It is secured to the support member 12 on top by a pair of threaded holes 26 that are provided in the insert assembly 18.

A pair of threaded machine screws 28 are inserted from the back (FIG. 2) through counter-sunk holes provided through the support member 12.

A pair of screws 30 are inserted from the front of the insert assembly 18 through openings provided and which engage with the support member 12 sufficient to secure the bottom of the insert assembly 18 in position. The tops of the screws 30 are disposed below the surface of the insert assembly 18 (so the surface of the insert assembly remains flush with the plane of the support member 12).

The insert assembly 18 includes a pair of vertical slots 32 that are parallel with respect to each other and which are disposed a predetermined distance apart from each other. The space intermediate the pair of vertical slots 32 is open.

The pair of vertical slots 32 extend from each end of the insert assembly 18 (i.e., from top to bottom) and are adapted for receiving a precision offset insert 34. The offset insert 34 includes a generally T-shaped cross-section where the "T" portion is adapted to fit into the pair of vertical slots 32 without binding or excessive looseness.

The offset insert 34 is preferably precision formed of a metal and it includes a generally upside-down, U-shaped opening 36 that is open at the bottom.

The offset insert 34 is inserted from the top of insert assembly 18 downward after alignment with the pair of vertical slots 32 so that the U-shaped opening 36 is facing downward. The offset insert 34 is urged downward in the vertical slots 32 until it is flush with the bottom of the support member 12.

The offset insert 34 includes a precision offset from the dowel 24 to a closest edge 52 of the insert 34, the offset being identified in general by the reference numeral 38. The offset 38 is the same as the nominal size of the dado cut, for example, ⅜ of an inch for a ⅜ inch wide dado blade.

The offset insert 34 is used to align the support member 12 with respect to the dado blade so that each successive cut that is made in the boards A, B includes the proper offset (i.e., the proper distance between them) as is also described in greater detail hereinafter.

If the dado blade were nominally intended to provide a ½ inch wide dado, then the offset insert 34 that would be used would be labeled for ½ inch use. Similarly, if the dado blade were nominally intended to provide a ¼ inch wide dado, then the offset insert 34 that would be used would be labeled for ¼ inch use, etc.

For each variation in the offset insert 34, the offset 38 would be varied to correspond with the nominal width of cut, again referenced from the dowel 24. Accordingly, the distance from the center of the dowel 24 to the center of the dado cut, after adjustment, will be equal to the nominal width of the dado.

The offset insert 34 is used to align the support member 12 right to left (i.e., perpendicular) with respect to the plane of the dado blade. The dado blade must fit into the U-shaped opening 36 in order to accomplish this, as is described in greater detail hereinafter. The U-shaped opening 36 must be larger than the dado blade to allow for the necessary right to left (i.e., side to side) adjustment. Accordingly, the U-shaped opening 36 is sized to accommodate the size of the dado blade it is intended for use with.

The offset insert 34 is used only to set the distance for the next cut. It is not left in the box joint fixture 10 during use. Therefore, the thickness of the offset insert 34 is not critical and, if desired, it can extend outward beyond the surface plane of the upright planar member 12*a*.

Prior to making any additional cuts, the offset insert 34 is removed from the insert assembly 18 and a zero clearance backer board 40 in then preferably placed in the pair of vertical slots 32 prior to making any additional cuts in either board A, B.

The clearance backer board 40 is used to provide rear support for the boards A, B during cutting and is preferably made of wood or other suitable material. The clearance backer board 40 includes a thickness that places it flush with the surface of the surface plane of the upright planar member 12*a*.

This provides support immediately behind the boards A, B that prevents them from chipping as the dado blade passes through them. The clearance backer board 40 is discarded after sufficient use has rendered it without sufficient material (because it is cut by the dado blade as well) and it is replaced when needed.

If a table saw or other device adapted to receive a dado blade is used, a rear member 42 is attached to a miter (not shown) by a pair of screws (not shown) that pass through the miter and which form a pair of corresponding holes 44 in the rear member 42 that correspond with the location of holes (not shown) in the miter.

The box joint fixture 10 is placed flat on the surface of the table saw and the pair of screws are inserted through the miter until they contact the rear member 42. They are then tightened sufficient to both form and engage with the pair of corresponding holes 44. Once tightened, the pair of screws secure the rear member 42 to the miter.

A pair of larger knurled nuts 46 each pass through one of a pair of horizontal slots 48 provided in the rear member 42. The larger knurled nuts 46 engage with a pair of countersunk nuts 50 that do not rotate and which are provided in the upright planar member 12*a*.

The larger knurled nuts 46 are loosened to allow sliding of the support member 12 relative to the rear member 42, and therefore relative to the miter. The miter glides toward the dado blade in a groove (not shown) on the table saw. Therefore, the miter is a fixed distance from the dado blade.

Accordingly, sliding the support member 12 relative to the rear member 42 is also sliding the support member 12 relative to the dado blade, which is what is intended to occur.

In use, the support member 12 is urged away from the dado blade an amount sufficient to allow the dado blade to pass generally through the U-shaped opening 36. The support member 12 is then urged gently toward the dado blade so that a closest edge of the dado blade lightly touches a closest side 52 of the offset insert 34. The desired offset 38 is thereby achieved.

The rear member 42 is tightened and the desired offset 38 is thereby preserved for the entire course of making the box joint (or plurality of box joints). The offset insert 34 is removed from the insert assembly 18 before making any actual cuts to prevent the dado blade from accidentally making contact with it.

If desired, a protrusion 54 shown in dashed lines could be added to the offset insert 34. The protrusion 54 may be included so as to render it impossible to place either of the boards A, B flush against the surface of the upright planar member 12*a*.

This would eliminate virtually all likelihood of forgetting the offset insert 34 in the insert assembly 18 during use and possibly damaging the dado blade. The protrusion 54 could also be used as a handle to more easily insert or remove the offset insert 34 from the pair of vertical slots 32.

A slight curved recess 56 is provided in the horizontal planar member 12*b* immediately under the dowel 24 to allow for when the dowel 24 is adjusted at a lower position.

Typically, the dowel 24 is adjusted as high as possible. This is to prevent the fingers of the box joint from spreading, thereby introducing error.

Referring now primarily to FIG. 3, is shown a sequence of steps, which when combined with the previous written description, allow use of the box joint fixture 10. To begin, the offset insert 34 is used, as was described hereinbefore, to set the offset 38 distance, and is then removed from the box joint fixture 10. The backer board 40 is then inserted in the pair of vertical slots 32.

The height of the dado blade is raised so as to cut a dado having a depth slightly greater than the thickness of the board. This so when both boards A, B are joined together at a right angle to form the box joint, a small amount of each finger (about 1/32 of an inch) extends beyond each corner. This excess is sanded smooth. A scrap board is used to adjust the height (i.e., the depth of cut).

A first board A is placed on the horizontal planar member 12*b* and a first dado cut 58 is made near one end where desired. It matters not exactly where the first dado cut 58 is made. As shown in Step 1, the first board A is placed adjacent the dowel 24 and the first dado cut 58 is made.

According to step 2, the first board A is then turned over (i.e., the side adjacent to the vertical planar member 12*a* is reversed) and the first cut 58 is placed over the dowel 24. The dowel 24 includes a blade recess 24*a* in the top end that a flat blade screwdriver can fit in.

The knurled nut 24 is loosened and the height of the dowel 24 is adjusted in the vertical slot 20 so the dowel 24 is about midway up the height of the first dado cut 58. The dowel 24 is rotated, using the blade recess 24*a*, until the longer portions of it bind against the sides of the first dado cut 58. The dowel 24 acts as a cam to center and secure the first cut 58 in place. The first cut 58 is centered with respect to a center longitudinal axis of the dowel 24.

The second board B is then placed adjacent to an end nearest the first cut 58 of the first board A and a second dado cut 60 is made in the second board B.

The first board A is pulled up off of the dowel 24. The second dado cut 60 in the second board B is placed adjacent to or over the dowel 24 as shown in Step 3.

According to Step 4, the first board A is again reversed (so that it is disposed the same side facing the vertical planar member 12*a* as in Step 1). The first cut 58 of the first board A is placed over the dowel 24 so that it is in alignment with the second cut 60 of the second board B.

A third dado cut 60 is simultaneously made through both the first and second boards A, B to complete Step 4.

The first and second boards A, B are then removed from the dowel 24, are offset, and are placed over the dowel 24 so the third cut 60 (of each board) is now over the dowel 24.

A fourth dado cut 64 is then made identical to the third cut 62 and the process is repeated for as many times as the height of the boards A, B allows to complete Step 5, in this case for also a fifth cut 66.

For Step 6, the top first board A is removed (since there is no more room in the first board A for any more dado cuts to be made) and the second board B is again offset one last time so that the fifth cut 66 (in this example) is over the dowel 24. A final sixth cut 68 is made in the second board B to complete all of the cuts for the box joint.

In all of the steps (1–6), the board(s) A, B are always urged down on the dowel 24 sufficiently far so that the bottom of the boards A, B rests on top of the horizontal planar member 12*b*, or if a part of the boards A, B are over the opening 14, so that the bottom of the boards A, B aligns with the plane (i.e., the top surface) of the horizontal planar member 12*b*.

To complete the box joint, the first and second boards A, B are urged together. The remaining pieces of wood between the dado cuts 58–68 are called fingers. When the first and second boards A, B are urged together, the fingers of the first board A fit into the dado cuts of the remaining second board B with the edges of the boards A, B, matching perfectly.

Normally, a quantity of glue is used and some method (i.e., another jig or fixture) is used to secure the boards A, B at the desired right angle until the glue is fully cured. Of course, prior to gluing, the process is repeated on the opposite end of the boards A, B if the opposite end is to also include a box joint.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A box joint fixture for use with a saw having a dado blade that is adapted for cutting a plurality of dado cuts in a pair of boards sufficient to form a box joint intermediate said pair of boards, comprising:

(a) a support member;

(b) an elliptical pin having a longitudinal length and a substantially oval cross-section, said elliptical pin attached to said support member; and (c) means adapted for setting an offset distance from said elliptical pin to said dado blade in said saw;

(d) wherein said offset distance is adapted for use with each of a plurality of remaining dado cuts to be made in said pair of boards.

2. The box joint fixture of claim 1 wherein said support member includes a vertical member and a horizontal member and including a vertical slot in said vertical member, said elliptical pin adapted to be displaced vertically in said vertical slot.

3. The box joint fixture of claim 1 wherein said support member includes a vertical member and a horizontal member and an insert assembly, and including an opening at a bottom of said support member adapted to allow passage of said dado blade therein, said insert assembly disposed in said vertical member and including a pair of parallel vertical slots that are disposed a predetermined distance apart from each other and including a vertical slot in said insert assembly, said elliptical pin adapted to be displaced vertically in said vertical slot.

4. The box joint fixture of claim 3 including an offset insert, said offset insert adapted for insertion in said pair of vertical slots and adapted to be displaced vertically along the length thereof to a bottom of said insert assembly, said offset insert including an upside-down substantially U-shaped bottom opening that aligns with a portion of said opening in said support member when said offset insert is disposed at a bottom of said insert assembly, said offset insert including an offset from a center of said elliptical pin to an edge in said substantially U-shaped bottom that is disposed closest to said elliptical pin, and wherein said offset corresponds with a nominal kerf of said dado blade.

5. The box joint fixture of claim 4 wherein said support member includes means for adjusting a position of said support member either closer to or further away from said dado blade.

6. The box joint fixture of claim 5 wherein said means for adjusting a position of said support member includes a rear member that is adapted to be attached to a miter of said saw, and wherein said rear member is slideably attached to said support member sufficient to displace said support member perpendicular with respect to a plane of said dado blade an amount sufficient to locate an edge of said dado blade that is disposed closest to said elliptical pin adjacent to said edge in said substantially U-shaped bottom that is disposed closest to said elliptical pin.

7. The box joint fixture of claim 6 including means for securing said support member to said rear member sufficient to retain said offset.

8. The box joint fixture of claim 2 including a backer board that is adapted to be disposed in said pair of vertical slots and wherein, when said backer board is disposed in said pair of vertical slots, said backer board includes a surface that is flush with a surface of said vertical board, and wherein said backer board is adapted to be cut by said dado blade.

9. The box joint fixture of claim 3 wherein said insert assembly includes means for fastening said insert assembly to said support member.

10. The box joint fixture of claim 4 wherein said offset insert includes a plurality of offset inserts, each of said plurality of offset inserts including an offset that corresponds with a kerf of a different width dado blade.

11. The box joint fixture of claim 2 wherein said vertical member includes a saw dust recess that extends along a longitudinal length of said vertical member proximate an intersection of said vertical member and said horizontal member.

12. The box joint fixture of claim 4 including means for preventing the use of said box joint fixture to cut said dado when said offset insert is disposed in said insert assembly.

13. The box joint fixture of claim 12 wherein said means for preventing the use of said box joint fixture includes means for preventing a surface of either of said pair of boards from being disposed adjacent to said vertical member when said offset insert is disposed in said insert assembly.

14. A box joint fixture for use with a router table having a cutting instrument attached thereto that is adapted for cutting a plurality of dado cuts in a pair of boards sufficient to form a box joint intermediate said pair of boards, comprising:

(e) a support member;

(f) an elliptical pin having a longitudinal length and a substantially oval cross-section, said elliptical pin attached to said support member; and (g) means adapted for setting an offset distance from said elliptical pin to said cutting instrument;

(h) wherein said offset distance is adapted for use with each of a plurality of remaining dado cuts to be made in said pair of boards.

15. A method for forming a box joint in an end of a first and second board, comprising the steps of:

a) providing a box joint fixture for use with a woodworking power tool having a cutting instrument that is adapted for cutting a plurality of dado cuts in a pair of boards sufficient to form a box joint intermediate said pair of boards, comprising:

(1) a support member;

(2) an elliptical pin having a longitudinal length and a substantially oval cross-section, said elliptical pin attached to said support member; and (3) means adapted for setting an offset distance from said elliptical pin to said cutting instrument in said woodworking power tool;

(4) wherein said offset distance is adapted for use with each of a plurality of remaining dado cuts to be made in said pair of boards;

b) placing an edge of a first of said two boards against said elliptical pin and making a first dado cut in said first board;

c) reversing said first board and placing said first dado cut over said elliptical pin;

d) placing an edge of a second of said two boards against said edge of said first board and making a second dado cut in said second board;

e) placing said second dado cut of said second board over said elliptical pin;

f) reversing said first board and placing said first board adjacent to said second board with said first dado cut disposed over said elliptical pin and making a third dado cut simultaneously in said first and second boards;

g) placing said third dado cut of said first and second boards on said elliptical pin and making an additional dado cut simultaneously in said first and said second boards;

h) repeating the above step until all possible dado cuts have been made simultaneously in said first and said second boards; and i) placing the last dado cut made in said second board on said elliptical pin and making a final dado cut in said second board.

* * * * *